US005141288A

United States Patent [19]

Smith

[11] Patent Number: 5,141,288

[45] Date of Patent: Aug. 25, 1992

[54] SIDE-DUMPING LOADING BUCKET AND CONTROL SYSTEM THEREFOR

[75] Inventor: Rutger Smith, Stockholm, Sweden

[73] Assignee: Nordiska Industrimaskiner AB, Stockholm, Sweden

[21] Appl. No.: 634,888

[22] PCT Filed: Jun. 30, 1989

[86] PCT No.: PCT/SE89/00376

§ 371 Date: Jan. 7, 1991

§ 102(e) Date: Jan. 7, 1991

[87] PCT Pub. No.: WO90/00650

PCT Pub. Date: Jan. 25, 1990

[30] Foreign Application Priority Data

Jul. 8, 1988 [SE] Sweden ..... 8802582

[51] Int. Cl.[5] ..... E02F 3/76; E02F 3/345

[52] U.S. Cl. ..... 298/17.6; 298/22 C; 414/705

[58] Field of Search ..... 414/705, 722; 37/117.5, 37/118; 298/17.6, 17.7, 18, 22 C

[56] References Cited

U.S. PATENT DOCUMENTS

| | | | |
|---|---|---|---|
| 3,203,565 | 8/1965 | Keskitalo | 414/705 |
| 3,402,841 | 9/1968 | Salna et al. | 414/705 |
| 3,531,007 | 9/1970 | Leijon | 414/705 |
| 3,556,330 | 1/1971 | Keskitalo | 414/705 |
| 3,620,458 | 11/1971 | Rath | 298/17.6 |
| 4,220,438 | 9/1980 | Anderson | 298/17.6 X |
| 4,307,992 | 12/1981 | Robnett | 414/705 |
| 4,341,026 | 7/1982 | Uchida et al. | 414/705 X |
| 4,568,028 | 2/1986 | Verseef et al. | 298/17.6 X |
| 4,773,598 | 9/1988 | Jones | 298/17.7 X |

FOREIGN PATENT DOCUMENTS

| | | | |
|---|---|---|---|
| 939756 | 11/1948 | Italy | 414/705 |
| 206432 | 12/1983 | Japan | 298/17.7 |
| 119019 | 6/1947 | Sweden | 298/22 |
| 1207843 | 1/1986 | Sweden | 298/17.6 |
| 1212852 | 2/1986 | U.S.S.R. | 298/17.6 |

*Primary Examiner*—Robert J. Spar
*Assistant Examiner*—Brian Dinicola
*Attorney, Agent, or Firm*—Sughrue, Mion, Zinn, Macpeak & Seas

[57] ABSTRACT

A side dumping loading bucket for pivoting a dumping bucket about a plurality of axes automatically includes a bucket having first and second sides oriented perpendicular to the centerline of the bucket, a holder having first and second sides and a second centerline substantially parallel to the centerline of the bucket, a dumping ram disposed substantially parallel to the centerline of the bucket and operatively connected between the bucket and the holder for dumping the bucket on a selected side, first and second journal assemblies located on the first and second sides of the holder and concentric with the axes and a hydraulic circuit including the dumping ram and the first and second journal assemblies for locking a selected journal assembly prior to unlocking the other journal assembly and for operating the dumping ram only after the selected and the other journal assemblies are locked and unlocked, respectively. The hydraulic circuit includes valves which prevent flow of hydraulic fluid unless the bucket is in a predetermined position with respect to the holder. The hydraulic circuit is sequenced so that the journal assembly opposite a selected pivot axis cannot be unlocked until the journal assembly concentric with the selected pivot axis is locked and so that the dumping ram cannot be operated until the journal assembly opposite the selected pivot axis is unlocked.

14 Claims, 3 Drawing Sheets

SIDE-DUMPING LOADING BUCKET AND CONTROL SYSTEM THEREFOR

FIELD OF INVENTION

The present invention relates to an arrangement of implements holders for assemblies including side-dumping excavating and loading buckets comprising a holder, a bucket, a hydraulic dumping ram for side-tipping the bucket around one of two journal assemblies. Each of the journal assemblies cooperates with locking devices to permit side-dumping about one of the journal assemblies based on the position of the locking devices. A hydraulic control circuit is provided which includes the side dumping ram and which sequences the locking devices to unlock the locking device on the side opposite which the bucket is to be dumped before the side dumping ram is operated.

State of the Art

Such an arrangement in implement holders for assemblies equipped with side-dumping excavating and loading buckets is previously known from SE-C-214 750 (The Frank G. Hough Company).

Excavating and loading assemblies of a similar kind are previously known to the art from, for instance, SE-A-8501093-2 (publication No. 447 742) (Leijon), SE-B-215 153 (Leijon) and SE-B-219 549 (Leijon), all three of which are further developments of the invention described in SE-B-166 157 (Bodin). This latter publication has a counterpart in U.S. Pat. No. 2,924,345 (Bodin).

The bucket of such an assembly shall be locked to the holder in the central position in some reliable manner, and to this end is provided with locking devices which co-act with the journal devices used. The journal devices may, alternatively, be releasable, such as to permit selective dumping on either side.

It has been found in practice, however, that in certain instances the bucket is not locked reliably to the holder. This may be due to the fact, for instance, that gravel, stones or dirt has penetrated those locations in which the locking devices are intended to grip, so that said devices are unable to move to their intended locking positions. At times, foreign particles of the aforesaid kind will fasten between the bucket-journaling devices carried by the holder and the bucket-journals co-acting therewith, such as to prevent the bucket from taking its intended rest or non-operative position. This means, in turn, that the locking devices are unable to take a position in which the bucket is locked correctly to the holder.

Malfunctioning of the bucket locking devices may also be due to other causes. For instance, subsequent to activating the operating valve for side-dumping in one direction, e.g. on the left, the operator may activate the controls for side-dumping in the other direction, on the right, before the first dumping operation has been completed.

Another drawback with this known arrangement is that there is a risk that the bucket will not be connected to the holder in the manner intended, but that the bucket simply lies and "rocks" on the holder, thereby subjecting the assembly to the risk of serious, and perhaps irreparable damage.

Of course, the large stresses to which a bucket of this kind is subjected and the particular enviornment in which the bucket works must be taken into account in this context.

The aforesaid drawbacks also apply to other known arrangements, for instance the arrangements described and illustrated in U.S. Pat. No. 3,022,910 (Anderson), U.S. Pat. No. 3,203,565 and U.S. Pat. No. RE-26268 (Keskitalo), U.S. Pat. No. 3,198,358 (Gardner), U.S. Pat. No. 4,307,992 (Robnett) and U.S. Pat. No. 4,341,026 (Uchida et al). The arrangements described in these publications are, as a rule, complicated and require the inclusion of a plurality of different circuits for operating the drive-locking arrangement provided, and these arrangements are also emcumbered with the aforesaid serious defficiency of unreliable locking of the bucket to the holder.

SE-B-355 848 (Leijon) describes a hydraulic drive arrangement for two mutually independent functions, sometimes referred to as "all-in-one-cylinder", which includes two double-acting hydraulic rams, the pistons of which each have a specific starting position and with which each of the pistons can be operated, through a locking device, in a direction from its starting position solely when the other piston is located in its starting position, said locking device comprising at least one hydraulic valve arrangement which is controlled mechanically by movable elements of the hydraulic system.

The drive arrangement may find advantageous use in an assembly which comprises a side-dumping bucket of the kind meant here, by virtue of the fact that it can be given a more compact and robust construction than other known hydraulic drive arrangements, thereby reducing the requirement of construction space to a corresponding extent, an advantage of the highest significance in connection with excavating and loading buckets.

In other respects, the known drive arrangement is characterized by the fact that none of the two hydraulic pistons is able to leave its starting position once one of the other pistons has left its starting position. Thus, when one of the hydraulic rams is active and its piston is moving, the other hydraulic ram remains inoperative, with its piston locked in its starting position.

Various different types of tractor implement holders for side-dumping buckets of the kind meant here are also known to the art from SE-B-308 487, SE-B-317 030 and SE-B-322 166 (all to Leijon). These known arrangements include different mechanical locking and latching arrangements for locking or latching the tipping bearings of the bucket, and are based on the principle that the bucket side-dumping movements are effected through a mechanical coupling located between the hydraulic ram or rams and the devices which lock the bearing shaft about which side-dumping is effected and release the opposing bearing shaft.

Such mechanical co-action between one or more tipping hydraulics and the locking devices of the journaling arrangements constitutes such problems in practice as to render its practical use impossible. This is due, among other things, because the work involved is often carried out in a difficult environment under the presence of large stresses on the various components, wherewith, in addition to clay, other forms of dirt and foreign substances are liable to penetrate and prevent reliable functioning of the purely mechanical components.

Further examples of the present state of techniques are found in U.S. Pat. No. 3,556,330 (Keskitalo) and WO-A1-80/01583 (Anderson).

Despite the fact that a number of mutually different constructions have been proposed in an attempt to solve the problem of positive locking of a side-dumping bucket to a holder for work with heavy and hard materials, such as rock, clay, etc., none of these solutions has been found satisfactory. Those systems which are based on some of the aforesaid publications to Leijon and which have been sold under the trademark LIBU for some 15 years, have been relatively expensive to manufacture and are not sufficiently reliable for application with loading buckets of sizes 6–20 $m^3$, primarily because it is risky to subject the mechanical locking devices to the increased hydraulic forces that occur when large buckets are used. Furthermore, present day locking devices and arrangements consist of a plurality of elements which are difficult to manufacture and also to fit.

Since there is a progressive demand for excavating units or machines capable of 3-way loading with the use of large bucket volumes, there is a need for an improved arrangement of the kind described in the introduction.

OBJECT OF THE INVENTION

With a starting point from the aforegoing, an object of the present invention is to provide an improved arrangement in an assembly of the kind concerned which exhibits improved operational reliability, which will simplify the work of the tractor driver in connection with maneuvering the bucket, and which will ensure accurate locking locking of the bucket to the holder in the central position.

A further object is to provide an arrangement of the aforesaid kind which will eliminate the risk of a side-dumping operation being executed when the components of corresponding locking devices do not co-act correctly with one another.

SUMMARY OF THE INVENTION

These and other objects are fulfilled by an arrangement according to the present invention, characterized in that each of the journal assemblies includes a locking device which, when activated by a piston rod connected to a piston of the locking or piston-cylinder device, is movable to a locking position which is concentric with the geometric axis of the journal assembly. The present invention is further characterized in that an hydraulic circuit includes devices which, subsequent to operation of the side-dumping ram, ensure that the bucket is locked on one side before movement of the locking device on the opposite side of the bucket.

The locking devices are moveable to the locking position concentrically with the geometric axis of the journaling so that it is possible, in compact and reliable configuration, to effect side dumping of the bucket and to provide the separate arrangements necessary in accordance with the invention to achieve the desired reliability of the assembly as a whole. The devices associated with the separate hydraulic circuits and required in accordance with the invention may namely be arranged in the close proximity of each journal arrangement and more specifically adjacent the valve blocks of said arrangements. These valve blocks are connected by hoses to a main block mounted centrally on the holder in connection with the centre part of the tipping ram and accommodating valve functions operative in effecting positive and safe selective side-dumping.

The hydraulic circuit includes a valve means, suitably a so-called kick-down-valve.

Because the function of a valve of this kind is dependent on a pre-determined pressure in a separate control circuit, which in turn presumes that a corresponding locking device has moved to its locking position, it is ensured that bucket dumping movement will not take place unless the locking device in question is outside its locking position.

An additional safety factor is achieved when, in accordance with one preferred embodiment, each of the hydraulic locking devices for effecting locking of the bearing arrangement is arranged to co-act with a valve arranged in connection with an opposing journaling device, suitably a so-called sequence valve, which advantageously provides hydraulic fluid to a first locking piston-cylinder device to unlock that device when the pressure supplied to a second locking-piston-cylinder device to lock that device exceeds a predetermined pressure.

The use of such a valve, which is preferably activated at a pressure of, for instance, 120 bars, which pressure is lower than the pressure at which the kick-down-valve is activated, e.g. a pressure of 140 bars, will ensure that the bucket will take a correct position, locked to both journaling devices, under all circumstances, before it is possible to side-tip the bucket.

In order to improve safety still further in this respect, the hydraulic circuit will preferably include a valve mounted in connection with each journaling arrangement, for instance a so-called button valve, which is mechanically activated to control hydraulic fluid flow based on the position of the bucket (3) with respect to the holder (2).

This valve is constructed for mechanical activation of the bucket when said bucket is located in its rest position on the holder, and is operative to prevent the flow of pressure fluid to either of the hydraulic locking devices—and therewith also indirectly to the tipping or dumping ram—unless the bucket is in its correct position on the holder at both ends.

It is preferred in practice that the hydraulic locking devices of the journaling arrangements co-act with separate sensors effective in detecting electro-inductively whether or not the locking devices have taken their correct locking positions, and if such is not the case in activating a latching valve which interrupts the supply of pressure fluid.

The assembly may also be provided with appropriate optical and/or acoustic and/or like devices which will make the tractor driver aware of any malfunctions or faults with regard to intended functions of the assembly.

The inventive arrangement, however, will circumvent or usual causes of malfunctioning encountered with earlier known assemblies of this kind, and also faults which are related to wrong handling of the assembly operating valve. For instance, if the driver activates the operating valve for side-dumping to the left and then changes his mind and immediately activates the valve for side-dumping to the right, the bucket of the inventive arrangement will automatically return to its starting position. It is necessary to produce new, positive operating pulses which initiate the aforedescribed control functions before the desired, alternative dumping movement can be effected.

Further characteristic features of the invention will be apparent from the following description of a preferred embodiment thereof. The description is made with reference to the accompanying schematic drawings.

DESCRIPTION OF A PREFERRED EMBODIMENT

Figure 1:
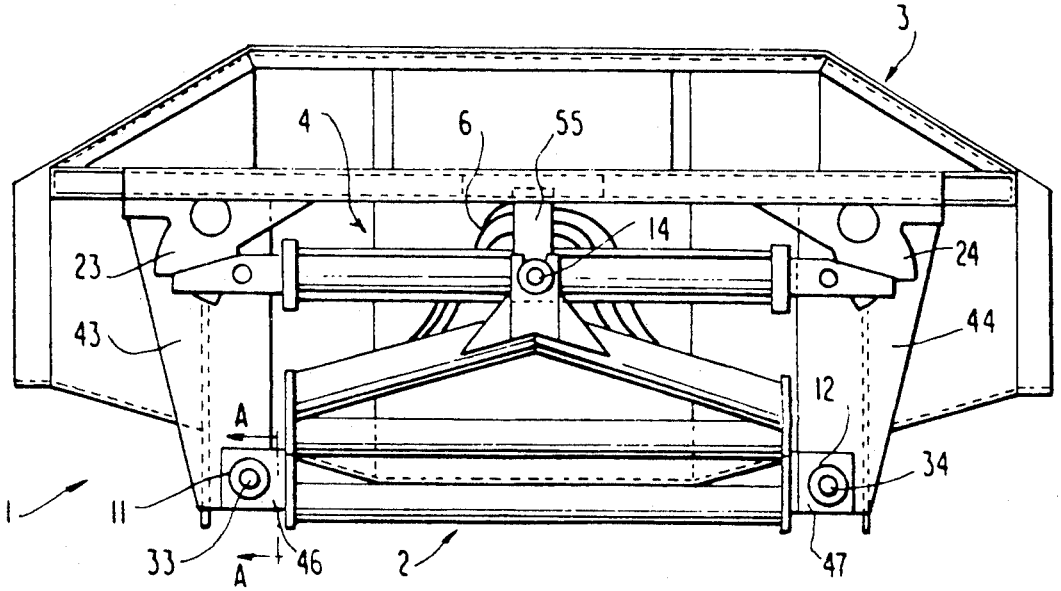
FIG. 1 is an elevation view of a tractor implement holder intended for an assembly which includes a side-dumping excavating and loading bucket in accordance with the invention.
Figure 2:
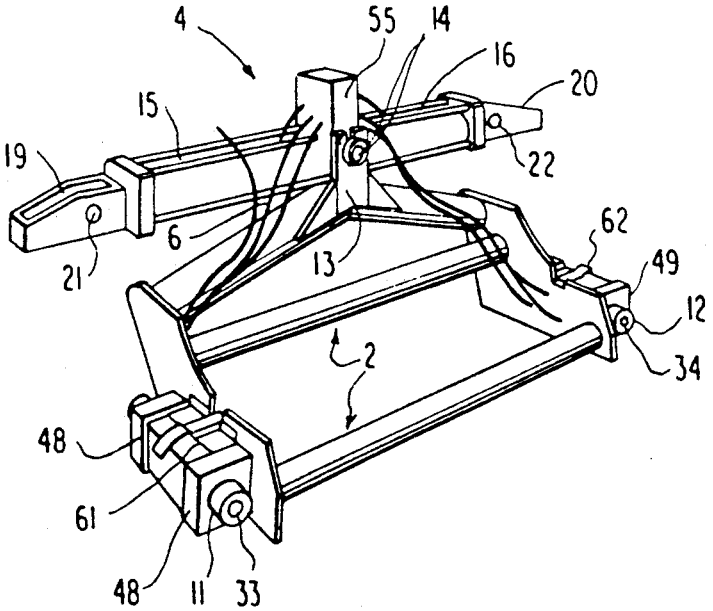
FIG. 2 is a perspective view of the assembly holder including bucket dumping hydraulic systems and journaling arrangements for bucket dumping movements.

Shown in FIGS. 1 and 2 is an excavating assembly comprising a holder 2 and an excavating and loading bucket 3. The holder is carried by tractor arcs which can be swung in the vertical plane such as to pivot the holder for front dumping of the bucket about a horizontal axis.

Figure 4:
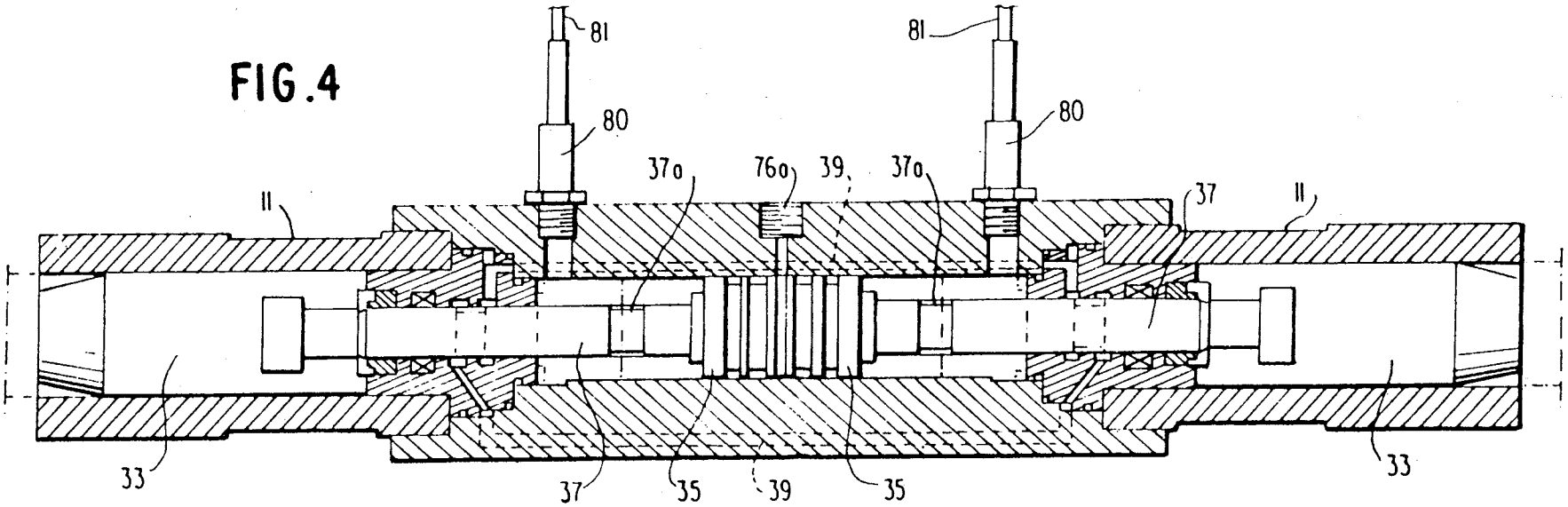
FIG. 4, finally, is a cross-sectional view of an assembly or journaling arrangement provided with hydraulic locking systems and locking devices.

The bucket 3 can also be swung for side-dumping relative to the holder 2, with the aid of a hydraulic dumping ram arrangement which is pivotally journaled to the holder and generally referenced by the numeral 4. The bucket can be tipped sideways about either one of two journal arrangements 11 and 12, each of which co-acts with a respective locking device 33, 34 so as to permit side-dumping about one of the journals, depending on the position of respective locking devices. The locking devices 33 and 34 are each activated by locking, hydraulic piston-cylinder devices, the general configuration of which is illustrated in FIG. 4.

In the case of the illustrated embodiment, the dumping ram 4 is a so-called all-in-one-ram having a central part 13 which is journaled on a shaft 14 for pivotal movement relative to the holder 2. The dumping ram includes two double acting piston-cylinder devices 15, 16, the pistons of which have a stirrup-like head 19, 20 mounted on the ends thereof and including a transverse pin or roller 21, 22 for engagement with a respective catch plate 23, 24 on the bucket.

Each of the pistons of the dumping ram is able to move from its starting position only when the other of said pistons is located in its starting position, as a result of the provision of a locking arrangement (not shown) provided in the central part 13. This locking arrangement comprises a hydraulic valve arrangement which is mechanically controlled by moveable elements of respective hydraulic rams.

Each of the stirrup-shaped heads 19, 20 is arranged to engage respective catch plates with some centimeters of free play.

The reference 6 identifies conduits forming part of a hydraulic circuit intended for action of the dumping ram 4 and the respective locking piston-cylinder devices of the journals 11, 12. This hydraulic circuit together with associated valve functions will be described in more detail hereinafter with reference to FIG. 3.

Figure 5:
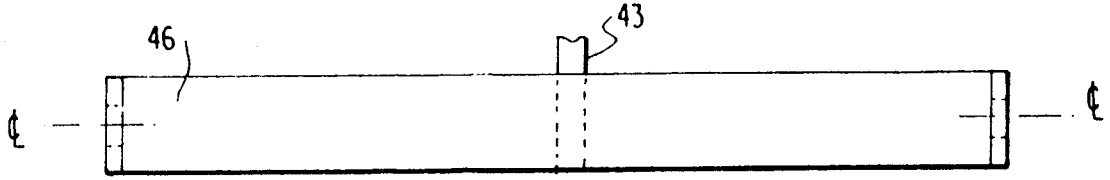
FIG. 5 is a sectional view taken along the line A—A in FIG. 1 for explaining the construction of parts 46 and 47.

Mounted on the bottom of the bucket 3 are two brackets 43, 44, each of which carries a journal element in the form of a part 46, 47 having a u shape or a horseshoe shape wherein the openings of parts 46 and 47 oppose one another and which are intended for coaction with the bearing shafts of respective journals 11, 12. See FIG. 5, wherein bracket 43 and part 47 are shown, as viewed from journal 11.

Figure 3:
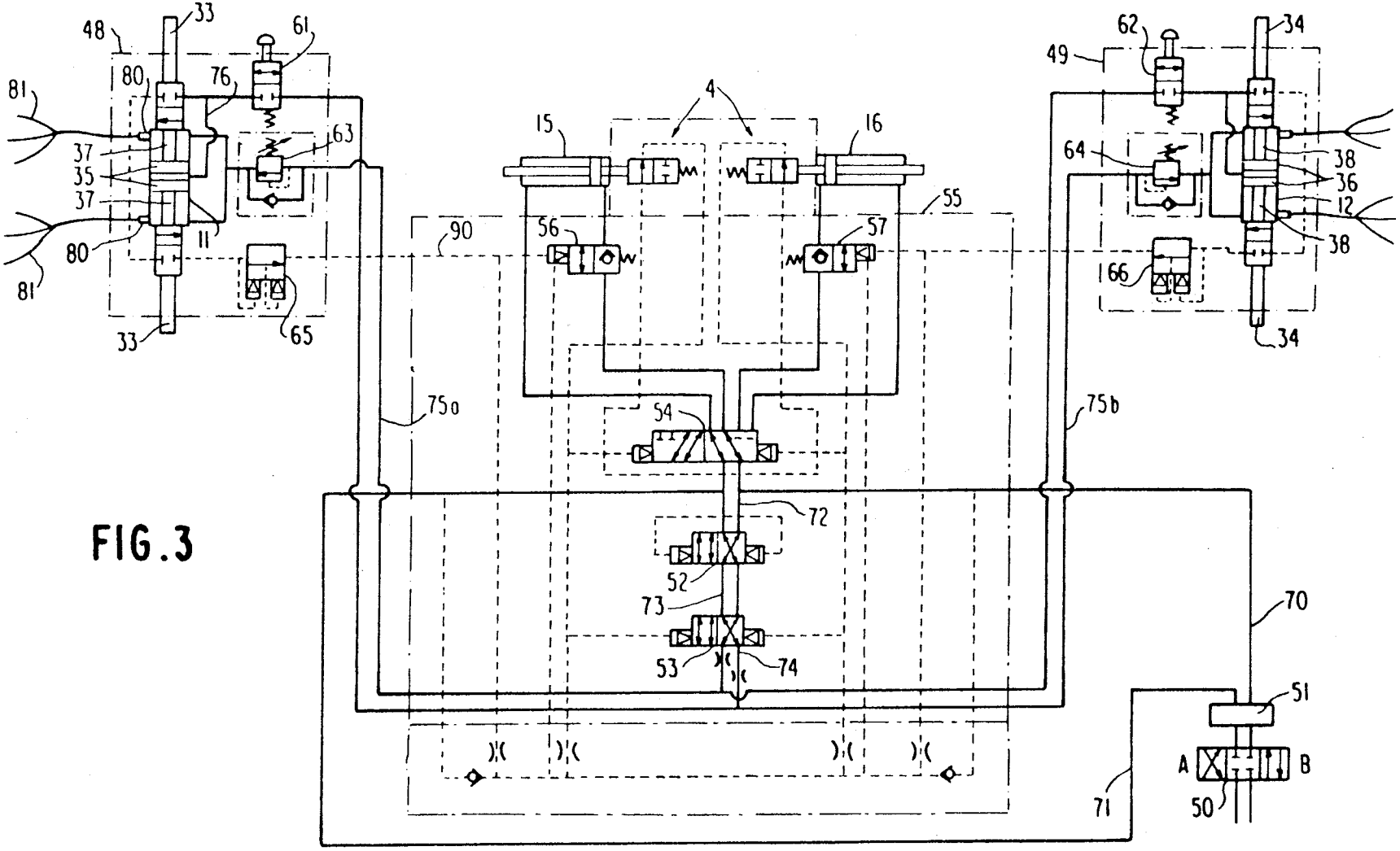
FIG. 3 illustrates a hydraulic circuit and shows the valve functions included in the hydraulic circuit of the assembly.

The tractor operating valve is referenced 50 in FIG. 3 and will have the state A when placing the pipe 70 under pressure for initiating side-dumping around the left journal 11. In this case, the pipe 71 is the return pipe. When side-dumping around the right journal 12, pressure is applied through the pipe 71 with the valve in the state B.

The pressure prevailing in the pipe 70 is applied to the central, main block 55 which, inter alia, includes the three valves 52, 53 and 54 with their respective valve images or states shown in FIG. 3. When the bucket is tipped sideways around the left journal, these valves are switched to their illustrated positions by means of illustrated pilot circuits.

All pilot circuits are drawn in broken lines in FIG. 3.

The valve block 48 connected with the left journal 11 has three valves, namely a button valve 61 operable by the bucket 3, a sequence valve 63 actuable at a predetermined pressure, e.g. 120 bars, and a kick-down-valve 65 operable at a higher pressure, e.g. 140 bars.

The button valve 61 is activated mechanically by the bucket 3, when the bucket is located in its rest position, wherewith the valve image for fluid passage is activated.

The sequence valve 63 activates its valve image for fluid passage when the aforesaid pre-determined pressure, e.g. 120 bars, is reached.

The kick-down-valve 65 activates its valve image for fluid passage when the aforesaid higher pressure, e.g. 140 bars, is reached.

The valve block 49 connected with the right journal 12 incorporates corresponding valve functions, namely a button valve 62, a sequence valve 64 and a kick-down valve 66.

Each dumping ram 15 and 16 respectively co-acts with a latching valve 56 and 57, each having an associated pilot circuit which is activated by a kick-down-valve 65 and 66 respectively.

When side dumping to the left, the valve image A of the operating valve 50 is established by the tractor driver, wherewith the pipe 70 is placed under pressure and the three valves 52, 53 and 54 in the main block 55 take the states illustrated in FIG. 3.

The pressure is propagated through the pipes 72, 74 and **75*b* to the button valve 61**, the fluid-passage valve image of which is established solely when the bucket is correctly positioned on the holder.

Presuming that the bucket is correctly position, propagation of pressure continues to the central part of the hydraulic piston-cylinder device 11, the pistons 35 and piston rods 37 of which move the locking devices 33 into their respective locking positions.

FIG. 4 illustrates an embodiment in which separate inductive sensors 80 are arranged in respective locking piston-cylinder devices, such as to detect whether or not the pistons of the locking devices have actually moved to their outer terminal positions. If this is not the case, an electrical latching valve, referenced 51 in FIG. 3, is activated, said valve then interrupting the supply of pressure fluid from the operating valve.

In the FIG. 4 embodiment, separate channels 37*a* are provided in the piston rods 37 such as to ensure the passage of fluid indicated by the broken line in FIG. 3, solely when the pistons are located in their outer terminal positions, such as to enable the sequence valve 65 to be activated in the manner described below.

The pressure prevailing in the pipe 76 has ensured that the locking pistons 33 have reached their terminal positions and that a higher pressure has been generated in the pipe 76 and 75*b*, this higher pressure propagating through the pipe 75*b* to the sequence valve 64 connected to the locking hydraulic piston-cylinder device 12 on the opposing side. When the pre-determined pressure of 120 bars has been reached in this circuit, the sequence valve is activated so as to permit fluid to flow, this fluid being supplied to the locking hydraulic piston-cylinder device of the right journal arrangement 12, such as to move the locking devices 34 to their release positions.

Subsequent hereto, the pressure in the pipe system 75*b*, 75*a*, 76 will increase until a pre-determined pressure of 140 bars has been reached, whereupon the kick-down-valve 65 is activated, in the manner described above with reference to FIG. 4. The latching valve 36 is then activated through the associated pilot circuit 90, this valve thus ensuring that hydraulic pressure is applied to the hydraulic dumping ram 15 such as to side-tip the bucket about the left journal arrangement.

It will be clear from the above description that all three valves 61, 64 and 65 have been activated prior hereto. Of these valves, the sequence valve 64 is connected to the opposing, right journal arrangement 12, whereas the other two valves, i.e. the button valve 61 and the kick-down-valve 65 are located in the region of the left journal arrangement.

If the locking devices 33 have not occupied their correct locking positions, for instance because the bucket 3 is wrongly positioned on the holder, the sequence valve 65 will not be activated and the buckets will not be tipped.

Correspondingly, the two button valves 61, 62 will check whether or not the bucket is in its correct position before pressure fluid is delivered for movement of either of the locking devices of said locking arrangement to its release position.

The description made with reference to FIG. 3 should be sufficient to provide one of normal skill in this art with an understanding of the function and purpose of the hydraulic system, i.e. it is thought unnecessary to describe in detail those events which take place when reversing the direction of flow, etc. The hydraulic circuit illustrated in FIG. 3 also shows the throttle functions provided in the various circuits.

The inductive sensors 80 shown in larger scale in FIG. 4 and operative to determine whether or not the piston rods 37—and therewith the locking devices 33—have been moved to their outer locking positions, are also indicated in FIG. 3. The active working parts of the piston rods 37 are preferably treated in a suitable manner, e.g. coated with a hardmetal layer.

The sensors 80 work in cooperation with electrical conductors 81 which supply current to the electrical latching valve 51, provided that the piston rods are not in their outer terminal positions.

I claim:

1. A side dumping loading bucket, comprising:

a bucket having first and second lateral sides each bisected by a first line and first and second bracket parts disposed on each of said first and second lateral sides of said bucket, respectively, and oriented substantially perpendicular to said first line;

a holder having first and second lateral sides bisected by a second line substantially parallel to said first line of said bucket;

dumping ram means disposed substantially parallel to said first and second lines and operatively connected to said bucket and to said holder for dumping said bucket on one of said first and second sides;

first and second journal assemblies located on said first and second lateral sides of said holder and disposed substantially parallel to said first and second bracket parts and substantially perpendicular to said dumping ram means, each of said first and second journal assemblies having a bore and comprising a plurality of locking devices disposed within said respective bore; and a hydraulic circuit including said dumping ram and said first and second journal assemblies for moving respective ones of said locking devices along said respective bore so as to lock a selected one of said first and second journal assemblies prior to unlocking the other of said first and second journal assemblies and for operating said dumping ram only after said selected one of said first and second journal assemblies is locked and the other of said first and second journal assemblies is unlocked;

wherein said first and second journal assemblies, said respective bore and said respective ones of said locking devices are mutually concentric with first and second axes about which said bucket pivots.

2. The side dumping loading bucket of claim 1, wherein said hydraulic circuit further comprises first and second valves operatively connected to said first and second journal assemblies, respectively, for permitting flow of hydraulic fluid to said first and second journal assemblies only when said bucket is located in a predetermined position with respect to said holder.

3. The side dumping loading bucket of claim 2, wherein said first and second valves are mechanically actuated valves.

4. The side dumping loading bucket of claim 2, wherein said hydraulic circuit further comprises third and fourth valves hydraulically connected with said first and second journal assemblies for permitting flow of said hydraulic fluid from said selected one of said first and second journal assemblies to said other of said first and second journal assemblies when the pressure of said hydraulic fluid is greater than a first predetermined value.

5. The side dumping loading bucket of claim 4, wherein said third and fourth valves are activated by said pressure of said hydraulic fluid.

6. The side dumping loading bucket of claim 4, wherein said hydraulic circuit further comprises fifth and sixth valves hydraulically coupled to said first and second journal assemblies, respectively, for permitting flow of said hydraulic fluid to said dumping ram means when said pressure of said hydraulic fluid exceeds a second predetermined value.

7. The side dumping loading bucket of claim 6, wherein said fifth and sixth valves are activated by said pressure of said hydraulic fluid.

8. The side dumping loading bucket of claim 6, wherein said third through sixth valves are activated by said pressure of said hydraulic fluid.

9. The side dumping loading bucket of claim 1, wherein said hydraulic circuit is characterized in that hydraulic fluid is supplied to said a selected one of first and second journal assemblies only when said bucket is disposed in a predetermined position with respect to said holder, in that said hydraulic fluid is supplied to the other of said first and second journal assemblies only when the pressure of said hydraulic fluid exceeds a first predetermined value and in that said hydraulic fluid is provided to said dumping ram means only when said pressure of said hydraulic fluid exceeds a second predetermined value greater than said first predetermined value.

10. The side dumping loading bucket of claim 1, wherein each of said first and second journal assemblies further comprises first and second pistons operatively connected to respective said locking devices by first and second piston rods, respectively, whereby operation of said first and second pistons produces movement in respective said locking devices along said respective bore.

11. The side dumping loading bucket of claim 10, wherein said locking devices are disposed so as to permit movement of said locking devices along a geometric center of said first and second journal assemblies defined by said respective bore in response to operation of said first and second pistons, respectively.

12. The side dumping loading bucket of claim 10, wherein said first and second piston rods include first and second channels for permitting flow of hydraulic fluid between a plurality of branches of said hydraulic circuit when one of said first and second piston rods is in a position corresponding to a locked position of one of said first and second journal assemblies.

13. The side dumping loading bucket of claim 1, further comprising and electrical circuit including first and second sensing elements for sensing an operative position of said first and second journal assemblies.

14. The side dumping loading bucket of claim 13, wherein said first and second sensing elements are inductive position sensors.

* * * * *